United States Patent [19]

Campoli

[11] 4,140,061

[45] Feb. 20, 1979

[54] SHORT-RANGE DISCARDING-SABOT TRAINING PRACTICE ROUND AND SELF-DESTRUCT SUBPROJECTILE THEREFOR

[75] Inventor: Ralph F. Campoli, Mine Hill, N.J.

[73] Assignee: The United States of America as represented by the Secretary of the Army, Washington, D.C.

[21] Appl. No.: 803,839

[22] Filed: Jun. 6, 1977

[51] Int. Cl.[2] ..... F42B 13/20

[52] U.S. Cl. ..... 102/92.7; 102/93

[58] Field of Search ..... 102/41, 49.4, 92.7, 102/93; 244/3.27, 3.28

[56] References Cited

U.S. PATENT DOCUMENTS

| | | | |
|---|---|---|---|
| 1,181,203 | 5/1916 | Alard | 244/3.28 |
| 2,986,091 | 5/1961 | Ferguson | 102/41 |
| 3,747,533 | 7/1973 | Rossmann | 102/92.7 |

FOREIGN PATENT DOCUMENTS

| | | | |
|---|---|---|---|
| 1157555 | 7/1969 | United Kingdom | 102/92.7 |

*Primary Examiner*—Verlin R. Pendegrass

*Attorney, Agent, or Firm*—Nathan Edelberg; Harold H. Card, Jr.; A. Victor Erkkila

[57] ABSTRACT

A short-range training practice round, for simulating a high energy type ammunition round, comprises a discarding-sabot containing a self-destruct subprojectile, e.g. of aluminum or steel, similar in external configuration to the heavy armor-piercing subprojectile simulated, and made up of a plurality, e.g. 3, of contiguous elongated mating segments held together during launch and subsequent flight by a heat-sensitive nose cap adapted to be heated by the airstream and disintegrate at a predetermined point in flight, allowing the segments to tumble in air, decelerate, and come to rest after a short flight.

12 Claims, 5 Drawing Figures

SHORT-RANGE DISCARDING-SABOT TRAINING PRACTICE ROUND AND SELF-DESTRUCT SUBPROJECTILE THEREFOR

GOVERNMENTAL INTEREST

The invention described herein may be manufactured, used and licensed by or for the Government for governmental purposes without to me of any royalty thereon.

BACKGROUND AND SUMMARY OF THE INVENTION

A serious range limitation exists, both in this country and in Europe, for training tank gunnery crews, due to the development of longer range artillery and the increase in population densities. Ammunition available for training-practice normally retains many of the high performance characteristics of the related combat ammunition, including long range.

The present invention relates to a new and improved short-range practice round for simulating the new kinetic energy type armor-piercing ammunition round which comprises a small-caliber armor-piercing subprojectile mounted in a full-caliber discarding-sabot and fired from a tank or other gun cannon at muzzle velocities exceeding 4000 feet per second. Although target practice rounds are available for simulating the spin-stabilizing discarding-sabot round, these are unsatisfactory for the newly developed fin-stabilized round, because they do not match the trajectory of the fin-stabilized round out to the desired ranges, and do not produce the same signature when fired.

In accordance with the present invention, a short-range practice round is produced by combining a self-destruct subprojectile with a conventional discarding-sabot. The subprojectile is an elongated body made up of a plurality of contiguous mating segments, releasable means for holding the segments together during launch and subsequent flight prior to release thereof, and means for releasing the releasable means at a desired point in flight, permitting the segments to separate from each other and rapidly decelerate by tumbling in air. The means preferably comprise a heat-sensitive nose cap which clamps the forward ends of the segments together and is adapted to disintegrate during flight at a predetermined aerodynamic temperature to release the segments. The rear ends of the segments are held together by means that is automatically releasable when the forward ends swing out after release thereof.

DETAILED DESCRIPTION OF A PREFERRED EMBODIMENT

Figure 2:
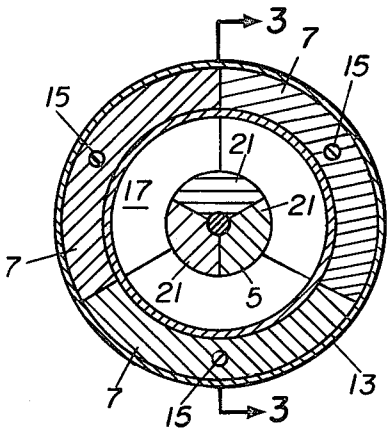
FIG. 2 is a transverse section view taken on line 2—2 of FIG. 1.
Figure 1:
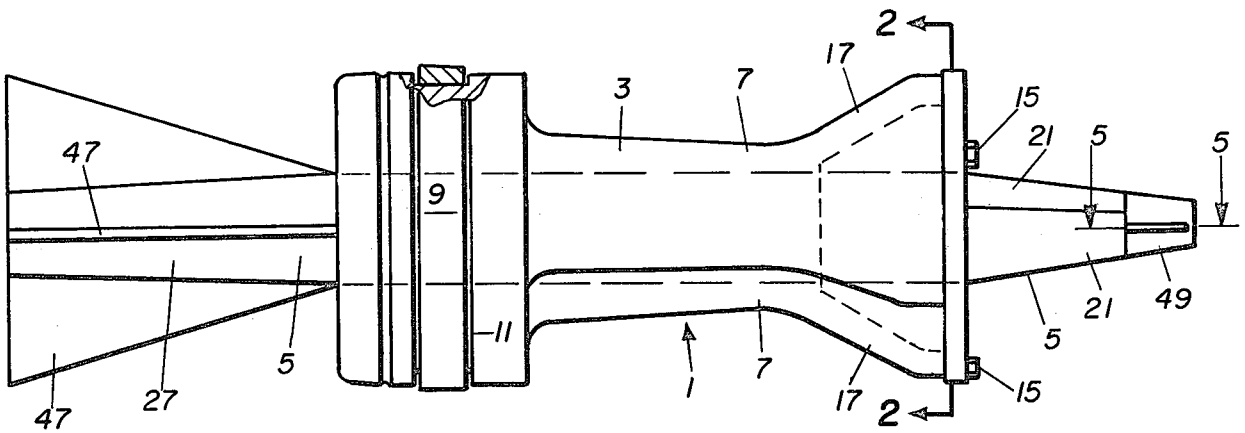
FIG. 1 is a side view of a target practice projectile embodying the invention.

FIGS. 1 to 5 illustrate a short-range target practice projectile 1, made up of a full-caliber annular discarding-sabot 3 and a small caliber self-destruct subprojectile 5. The sabot 3, which is conventional, is made up of three identical elongated parts of segments 7, of metal of plastic, releasably clamped together in a circular array by a rear nylon obturator slip band 9 seated in an annular groove 11, and a flanged annular metal band 13 attached, as by threaded studs 15, to the forward ends of outwardly-flared portions 17 of segments 7. The band 13 is formed with three notches 19 (see FIG. 3) to permit rupture of the band 13 after the projectile 1 is spin-launched from a rifled gun barrel (not shown). The nylon rear band 9 is ruptured at launch by muzzle gas pressure, after which the segments 7 swing out by centrifugal force and rupture the front band 13, and the sabot is discarded. The maximum diameter of the sabot 3, on either side of groove 11 and at the band 13, is such that the projectile is guided, with no appreciable friction, through the gun barrel. The outer diameter of the obturator slip band 9 is greater than the circle diameter of the spiral rifling lands of the barrel, so that the band 9 is engraved by the lands against the sabot 3. Band 9 provides obturation and induces low rotation due to slippage between band 9 and sabot 3.

The subprojectile 5 comprises a group of three elongated metal segments 21 having 120° mating surfaces nested together to form a cylindrical body 23 having a convergent front end 24. Preferably, the segments 21 fit snugly within the annular sabot 3, and the segments 7 and 21 are axially locked together by interlocking annular grooves and ribs, as shown at 25. Also, the mating surfaces of the subprojectile 5 are preferably staggerd, circubferentially, with respect to the mating surfaces of the sabot 3, as shown in FIG. 2.

The subprojectile 5 further includes a solid metal tail section 27, releasably attached to the rear ends of the segments 21 by a tapered plug-and-socket connection 29. The connection 29 comprises a convergent conical surface 31 on the rear ends of segments 21, which fits within a forwardly-divergent conical recess 33 in the forward end of tail section 27, and a tension stud 35 having a rear end threaded at 37 into the tail section 27 and a headed forward end 39 seated in a similarly-shaped recess or bore 41 in the segments 21. The under surface of head 39 is chamfered, at 43, at a suitable angle relative to the cone angle of surface 31, and the inner surfaces of the segments 21 at the ends thereof are flared outwardly, at 45, to permit the outward swinging of the segments 21 and separation of the tail section 27 from the segments 21 upon release of the forward ends of the segments 21. Preferably, the tail section 27 has a small convergent taper, from front to rear, and is provided with axially and radially-extending stabilizing fins 47.

Figure 3:
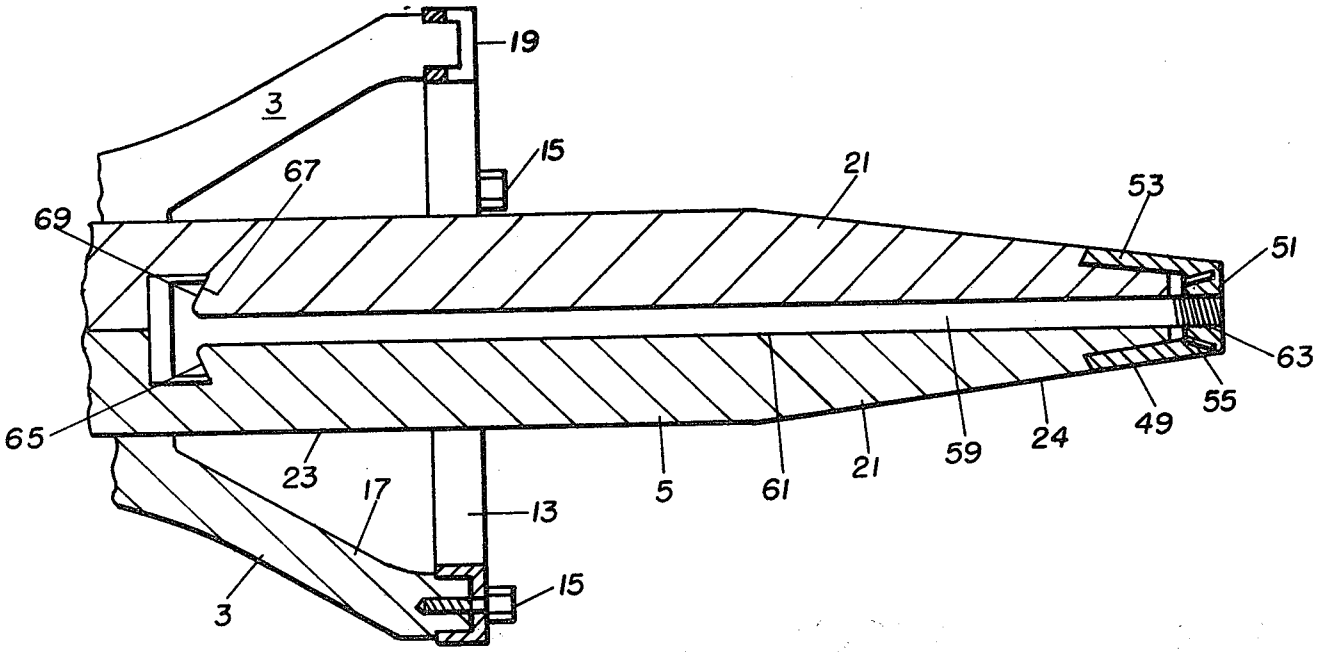
FIG. 3 is an enlarged axial section view of the front portion of the projectile of FIG. 1, taken on line 3—3 thereof.
Figure 5:
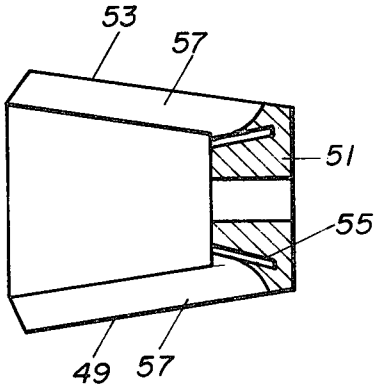
FIG. 5 is an axial section view of the nose cap of FIG. 1, taken on line 5—5 thereof.
Figure 4:
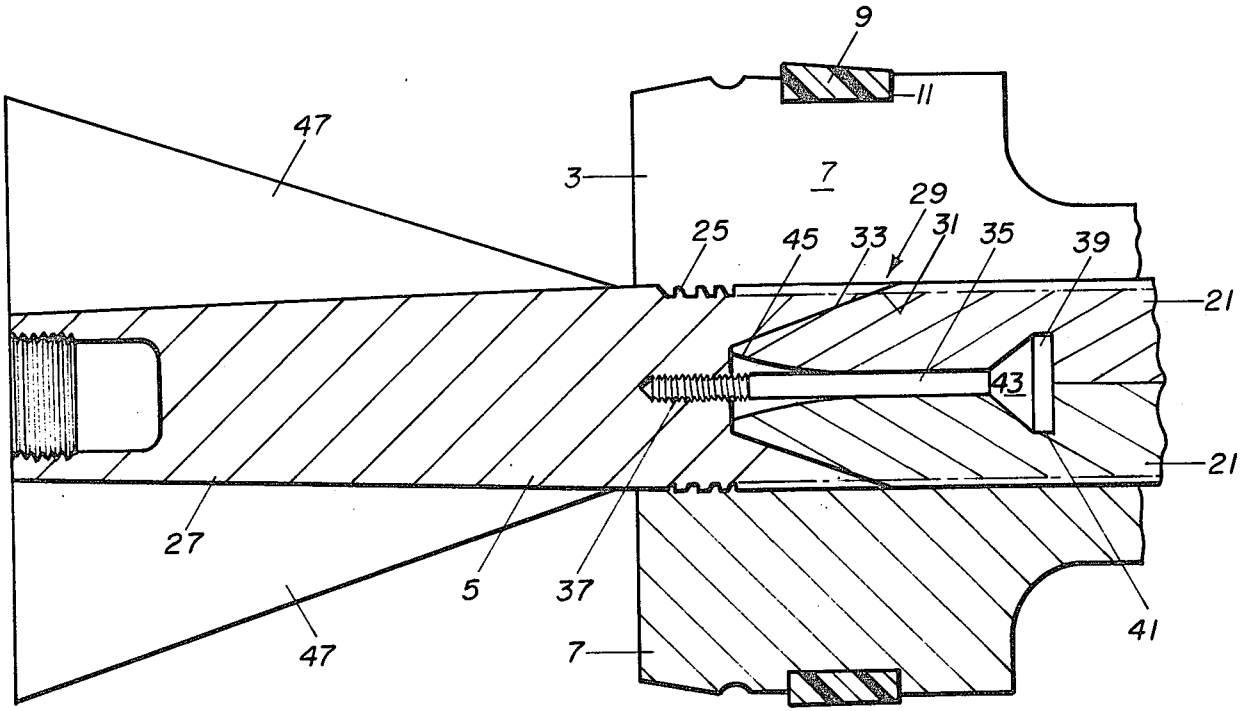
FIG. 4 is a similar section view of the rear portion of the projectile of claim 1.

The forward ends of the subprojectile segments 21 are releasably held together by means of a heat-sensitive metal nose cap 49, shown separately in FIG. 5. Nose cap 49 is a cup-shaped member made up of a base 51, and an outwardly-tapered skirt 53 that fits over a reduced-diameter front end portion of the convergent end 24, as shown in FIG. 3. The base 51 has an annular groove 55 which intersects a pair of diametrically-opposed longitudinal slits 57 in the skirt 53, to facilitate separation of the base from the skirt when heated. The nose cap 49 is axially held against the segments 21 by an elongated headed rod 59, seated in a headed axial bore 61 in the segments 21, and threaded at 63 into the base 51. The underside of the rod head 65 has a concave surface 67 which fits against a complemental surface 69 in the bore 61, and the base 51 of the nose cap is spaced sufficiently from the front ends of segments 21 to initially clamp the segments 21 togehter and yet permit the segments to swing outward at the front ends upon disintegration of the front portion of the nose cap by air friction during flight.

Preferably, the practice round is designed to simulate as near as possible the first portion of the trajector of a particular fin-stabilized armor-piercing round, up to the point where the subprojectile self-destructs due to disintegration of the nose cone in the airstream. For example, the prototype combat round may comprise a propelling charge and a 105 mm high-velocity projectile including a full-caliber discarding-sabot and a high energy type armor-piercing subprojectile having an average range of about 30 miles, and the practice round may be designed to cause its subprojectile to follow substantially the same trajectory as the combat subprojectile for the first 5 miles thereof and then self-destruct. In this case, the practice round would have substantially the same sabot and propelling charge, and the self-destruct subprojectile would have substantially the same external configuration, and hence, the same aerodynamic characteristics as the subprojectile of the combat round. The target would be located ahead of the self-destruct position, so that the accuracy of the gunnery crew can be determined. The range of the practice round may be varied by changing the dimensions and/or frontal area and shape of the nose cap 49. A decrease in working pressure will result due to the lighter load reducing gun wear and permitting a larger number of training rounds to be fired from one barrel.

Preferably, the material of the subprojectile of the practice round is aluminum or steel, which is much cheaper than the heavy metal normally used in the combat round. Moreover, where aluminum is used, the short range training or practice round can even be used in actual tank engagement training exercises, since the aluminum practice subprojectile will not be capable of penetrating the armor of the tank.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. In a short-range training practice round for simulating a long-range prototype ammunition round of given caliber including an elongated armor-piercing fin-stabilized sub-projectile and a discarding-sabot of said given caliber mounted on said sub-projectile and adapted to be launched from a gun barrel; a self-destruct fin-stabilized practice sub-projectile for simulating said armor-piercing sub-projectile, comprising:

an elongated body made up of a plurality of contiguous mating segments;

releasable means for holding said segments together during launch and during flight prior to release thereof; and means for releasing said releasable means at a desired substantial distance in flight, thus permitting said segments to separate from each other and rapidly decelerate by tumbling in air, said distance being sufficient to simulate a substantial portion of the trajectory of said prototype round but substantially short of the full range thereof prior to self-destruct of said practice subprojectile.

2. A subprojectile as in claim 1, wherein said means comprise a heat-sensitive nose cap having a side wall clamping portions of said segments together; said cap being adapted to disintegrate in flight at a predetermined aerodynamic temperature to release said segments.

3. A subprojectile as in claim 2, wherein said side wall of said nose cap is formed with two diametrically-opposed longitudinal slits extending from the open end thereof nearly to the base thereof, and the base of said cap is formed with an annular groove intersecting said longitudinal slits.

4. A subprojectile is in claim 2, wherein said means further comprises an axial rod having a forward end threaded into said nose cap and a headed rear end seated in a similarly-shaped axial bore in said body segments.

5. A subprojectile as in claim 4, wherein the underside of said rod head has a concave surface fitting a complemental surface on said body segments for clamping said segments together, and the axial length of the head of said bore is sufficiently greater than the head of said rod to permit outward swinging of said elements after disintegration of said cap.

6. A subprojectile as in claim 1, wherein:

said body comprises at least two identical elongated segments having radial and longitudinal mating surfaces;

said releasable means comprises first means for holding the rear ends of said segments together, and second means for holding the forward ends of said segments together; and said releasing means comprises means for disabling said second means at a predetermined point in flight.

7. A subprojectile as in claim 5, further comprising a tail section axially aligned with said body and attached thereto by means forming a part of said first means, said tail section having axially and radially extending fins for fin-stabilizing said subprojectile during flight.

8. A subprojectile as in claim 7, wherein said attaching means comprises:

a forwardly-diverging conical recess in the forward end of said tail section:

a complemental conical surface on the rear ends of said body segments; and an axial rod, having a rear end threaded into an axial bore in said tail section and a headed forward end seated in a similarly shaped axial bore in said body, for clamping the conical parts together during flight.

9. A subprojectile as in claim 8, wherein the head of said rod has an under surface that is chamfered, and the axial bore in said body is flared ourwardly, to permit the outward swinging of said segments upon release of the forward ends thereof.

10. A short-range training practice projectile, for smiulating a long-range prototype ammunition projectile of given caliber including a elongated armor-piercing subprojectile and discarding sabot mounted on said subprojectile and adapted to be launched from a gun barrel, including an annular discarding-sabot of said caliber and an elongated self-destruct subprojectile axially mounted within said sabot;

said sabot comprising a plurality of identical contiguous elongated mating parts having radial and longitudinal mating surfaces, and frangible means for holding said parts together until after launch;

said subprojectile comprising a plurality of identical contiguous elongated mating segments having radial and longitudinal mating surfaces that are circumferentially staggered with respect to the mating surfaces of said sabot parts, releasable means for holding said segments together during launch and during flight prior to release thereof, and means for releasing said releasable means at a desired point in flight, thus permitting said segments to separate from each other and rapidly decelerate by tumbling.

11. A projectile as in claim 10, wherein said releasable means and said releasing means comprise a heat-sensitive nose cap clamping the forward ends of said segments together; said cap being adapted to disintegrate in flight at a predetermined aerodynamic temperature to release said segments.

12. A projectile as in claim 11, wherein:

the prototype ammunition projectile being simulated is a 105mm high-velocity projectile including a full-caliber discarding-sabot and a high energy type armor-piercing subprojectile having an average range of about 30 miles; and said short-range training practice projectile is designed to cause its subprojectile to follow substantially the same trajectory as the subprojectile for the first 5 miles thereof and then self-destruct.

* * * * *